United States Patent [19]

Pettijohn et al.

[11] 4,299,904

[45] Nov. 10, 1981

[54] PHOTOGRAPHIC IMAGE ENHANCEMENT METHOD EMPLOYING PHOTOLUMINESCENCE

[75] Inventors: Richard R. Pettijohn, Portola Valley; Charles Leung, Redwood City; Ronald G. Manning, Menlo Park; Zoila Reyes, Menlo Park; Malcolm Thackray, Menlo Park, all of Calif.

[73] Assignee: SRI International, Menlo Park, Calif.

[21] Appl. No.: 964,119

[22] Filed: Nov. 28, 1978

[51] Int. Cl.[3] ..... G03C 5/17

[52] U.S. Cl. ..... 430/139; 430/494; 430/461; 430/371; 250/477; 430/945

[58] Field of Search ..... 96/1 R, 12, 45.1, 60 R, 96/82, 27 F; 427/157, 145; 430/139, 494, 461, 371, 367; 250/477, 483, 487, 494

[56] References Cited

U.S. PATENT DOCUMENTS

| | | | |
|---|---|---|---|
| 1,093,503 | 4/1914 | Traube | 430/367 |
| 1,966,322 | 7/1934 | Tuttle | 96/45.1 |
| 2,302,645 | 11/1942 | Switzer et al. | 427/157 |
| 3,205,071 | 9/1965 | Finnis | 430/139 |
| 3,236,776 | 2/1966 | Tomanek | 96/45.1 |
| 3,704,066 | 11/1972 | Young | 96/45.1 |
| 3,753,714 | 8/1973 | Sugiyama et al. | 96/45.1 |
| 3,801,324 | 4/1974 | Postal | 96/45.1 |
| 3,933,488 | 1/1976 | Noguchi et al. | 96/82 |
| 3,945,822 | 3/1976 | Verhille | 96/82 |
| 4,070,577 | 1/1978 | Lewis et al. | 250/315 A |
| 4,101,784 | 7/1978 | Askins | 430/494 |

OTHER PUBLICATIONS

The Focal Encyclopedia of Photography, vol. 1, 1965, p. 109.

The Theory of the Photographic Process, James et al., MacMillan, 4th ed. 1977, p. 447.

*Primary Examiner*—Richard L. Schilling
*Assistant Examiner*—John L. Goodrow
*Attorney, Agent, or Firm*—Victor R. Beckman

[57] ABSTRACT

A method of enhancing photographic images of low optical density is disclosed which includes use of a luminescent system, the components of which system include, at least, photoluminescent material and a source of photons for exciting the same to luminescence. A photoluminescent replica of the low optical density photographic image is produced which replica is exposed to photons required for luminescence of the photoluminescent image replica which luminescence is recorded, or photographed, for an amount of time necessary to achieve enhancement of the photographic film image. The image enhancement method may be used for the enhancement of photographic images produced by photographic processes including, for example, those which involve the use of different radiant energy sensitive material such as silver halide as used in 'conventional' photography, photoconductive material as used in electrophotography, organic compounds as used in diazo photographic processes, and the like.

5 Claims, 4 Drawing Figures

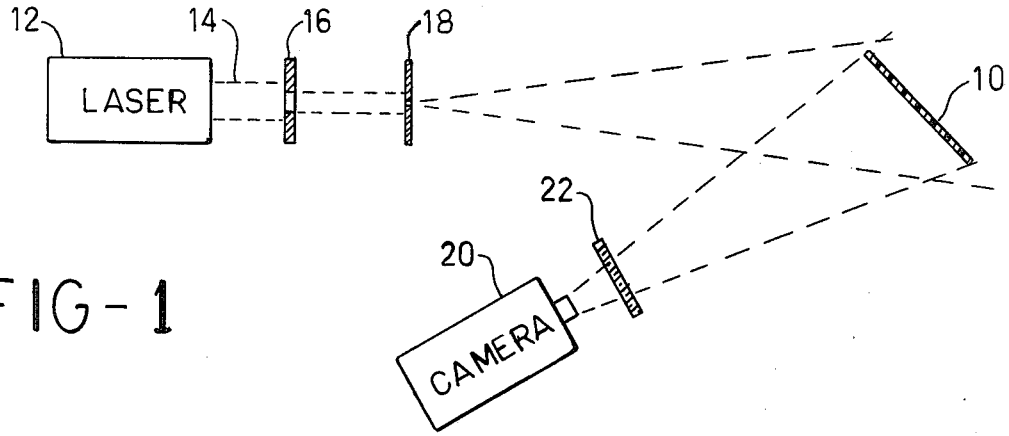
FIG-1
FIG-2
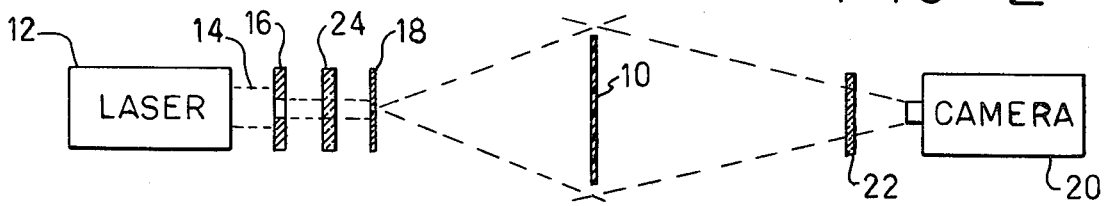
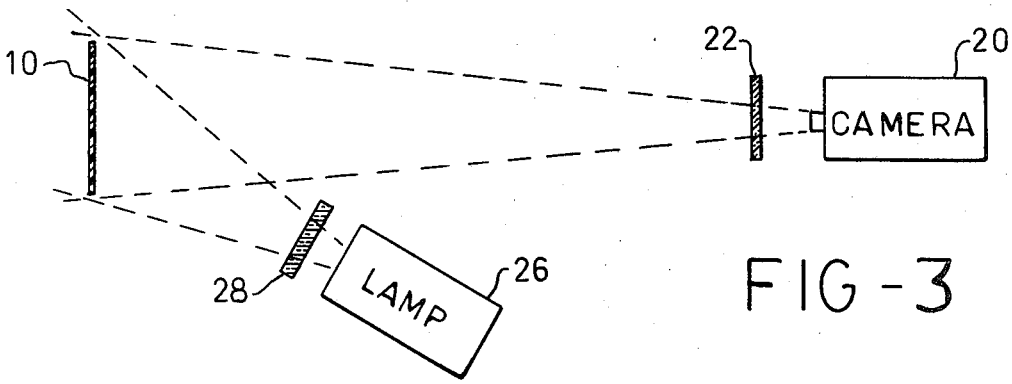
FIG-3

PHOTOGRAPHIC IMAGE ENHANCEMENT METHOD EMPLOYING PHOTOLUMINESCENCE

BACKGROUND OF THE INVENTION

Various methods for the enhancement, or intensification, of photographic images are known, which methods often are used for the enhancement of low optical density images. One such method of photographic image enhancement involves the deposition of copper on the silver image of a conventionally developed silver halide-emulsion film, as disclosed, for example, in U.S. Pat. No. 3,674,489 issued July 4, 1972. A basic problem with all such methods of intensification is that large amounts of material must be diffused through the gelatin matrix to increase the size of the grains forming the image. Some of this material frequently deposits at places other than the image and spoils the photograph. In addition, if the photographic image includes dense areas, such areas are completely blocked if sufficient material is deposited for image enhancement of the low optical density areas included thereon.

Autoradiographic photographic image enhancement methods also are known wherein the photographic image is made radioactive in an amount related to the optical density thereof. The radioactive film is placed adjacent a radioactive-sensitive film for exposure thereof to nuclear radiation emitted thereby. Exposure to the radioactive image source continues until the film is properly exposed, after which it is developed. With such nuclear intensification technique, resolution is limited by the resolution of the original negative, the resolution of the autoradiographic film, the evenness of the autoradiographic film contact during exposure, and the range of the radioactive emissions. Since the random direction emissions cannot be conveniently focused, the highest resolution intensification is obtained by contact autoradiography. Additionally, such technique requires specialized equipment and personnel trained in radiochemistry.

With many photographic image enhancement methods the original photographic image is destroyed and can not be readily reconstructed or restored to its original form.

SUMMARY OF THE INVENTION AND OBJECTS

An object of this invention is the provision of an improved method of photographic image enhancement which avoids many of the above and other shortcomings of prior art image enhancement methods.

An object of this invention is the provision of an improved method of enhancing photographic images which is well adapted for use with such images having low optical density, or contrast.

An object of this invention is the provision of a nondestructive photographic image enhancement method wherein restoration of the original photographic image is possible.

The above and other objects and advantages of this invention are achieved by use of a luminescent system which includes as components photoluminescent material and a source of photons for exciting the same for luminescence. The photographic image to be enhanced is made photoluminescent by providing thereon a photoluminescent material in proportion to the localized radiant energy exposure of the original underexposed film. Focusing lens means are used to focus the luminescent energy onto light sensing means, such as a photographic film for exposure thereof. A new image is thereby provided in which the degree of intensification is controlled by duration of luminescence exposure.

The invention will be better understood from the following detailed description considered with the accompanying drawings.

BRIEF DESCRIPTION OF THE DRAWINGS

In the drawings, wherein like reference characters refer to the same parts in the several views:

FIGS. 1, 2 and 3 show in simplified, diagrammatic form three different optical configurations for photoluminescent excitation of a fluorescent image replica which may be employed in the practice of the present invention.

DETAILED DESCRIPTION OF THE INVENTION

Photography, in general, involves the production of images through the action of radiant energy. Various photographic methods are known which make use of different radiant energy sensitive materials such as silver halides, photoconductors, light sensitive organic compounds, and the like. The present invention is directed to the enhancement of photographic images produced by any such process, which invention involves the use of luminescent means. The present invention provides for image enhancement of photographs to increase effective speed, resolution, and contrast of images, and is used anywhere photographs are interpreted. Such use includes, for example, intelligence and medical photointerpretation. For medical applications, for example, the dose to the patient could be decreased to a safe, or safer, level by purposely underexposing the film, followed by luminous intensification in accordance with the present invention. For purposes of illustration only, and not by way of limitation, several examples of methods of image enhancement involving the enhancement of conventional metallic silver images are disclosed.

As is well understood photographic film conventionally comprises fine crystals of silver halide, such as AgBr, uniformly disbursed in gelatin on a suitable support. After exposure to light from a camera image the sensitized AgBr is reduced in a developer to $Ag+Br^-$, after which the unsensitized AgBr grains are dissolved and washed away leaving an original silver particle image of the camera image. For information retrieval using prior art methods a minimum density above base fog of approximately 0.3 optical density units is required. The method of the present invention may be employed for the enhancement of photographic images of even lower optical density.

PHOTOLUMINESCENCE TYPE IMAGE ENHANCEMENT WITHOUT FLUORESCENT IMAGE TRANSFER

As noted above, the photographic image enhancement method of the present invention includes making the photographic film image photoluminescent, and exciting the same to luminescence by means of a photon source. In one embodiment of the invention a fluorescent dye is used to make the photographic fim image photoluminescent. Various methods of producing such a fluorescent dye image may be employed. In accordance with one method such a fluorescent dye image may be obtained by first converting the original metallic silver image to a silver halide image, such as a silver iodide image. Conversion from silver to silver iodide may be effected, for example, by treatment of the original silver negative image with an aqueous solution containing 4% $K_3Fe(CN)_6$ and 2% KI to bleach the same. Bleaching time is dependent upon the film type of the original negative and may vary between, say, 0.5 and 6 minutes. The film is rinsed in water to remove the bleach solution from the gelatin and then is treated in a suitable solution, such as a 20% $Na_2SO_4$ solution, to harden the gelatin. This treatment also is followed by a water rinse.

The bleached image then is toned as by use of a solution comprising a fluorescent dye which is adsorbed by the silver halide image. The dye is held in the same relative position and in the same proportion as the density of the silver iodide. Any suitable fluorescent dye may be used, including rhodamine B. After toning, the film is washed with water for removal of non-image dye therefrom.

In the use of a fluorescent dye, such as described above, the luminescent system includes also a photon source of proper wavelength for excitation of the dye and resultant emission of radiation therefrom. Where the dye comprises rhodamine B, a photon source is used for the excitation thereof. Several different optical systems for exciting the dye and viewing the fluorescing dye image are illustrated in FIGS. 1–3 of the drawings wherein the film which carries the fluorescent dye replica, or image, is identified by the reference numeral 10. In FIG. 1 a laser 12, is used to uniformly irradiate the film 10. The beam 14 from the laser first is collimated, as by passing the same through an apertured member or collimating means 16, and then expanded by passage of the collimated beam through a beam expander 18.

The fluorescing dye image at film 10 is recorded by suitable light responsive means such as photographic film, a video camera, or the like, from which an enhanced image thereof may be obtained. In the drawings, including the FIG. 1 arrangement, a camera 20 is shown for recording the fluorescing image. As seen in FIG. 1 a cutoff filter 22 is located between the fluorescing film 10 and camera to prevent reflected excitation light from the film from entering the camera and exposing film included therein. Exposure times depend, inter alia, upon the density of the original film and the amount of fluorescent dye adsorbed. Where a camera is employed as illustrated for viewing the fluorescing image, it will be apparent that a focusing lens, or lens system, for focusing the fluorescing image at the film 10 onto the camera-contained film is included as part of the camera.

In the FIG. 1 arrangement wherein the fluorescing image is illuminated and viewed from the same side of the film 10, the support for the image may be transparent or opaque. In the modified form of optical system illustrated in FIG. 2 the fluorescent dye replica is excited by directing photon energy onto one side of the film, and viewing the flourescing image from the opposite side. In this case a transparent support for the fluorescent image is required through which the exciting photon or fluorescing visible energy may be transmitted. A band pass filter 24 is included in the collimated beam portion thereof to select the desired wavelength for fluorescence excitation. The remainder of the optical system components are described above with reference to the FIG. 1 arrangement, and perform corresponding functions.

In FIG. 3, to which reference now is made, an optical system similar to that of the FIG. 1 arrangement is shown except that a lamp 26 is used in place of the laser 12, collimator 16 and beam expander 18. Additionally, a suitable filter 28 is employed at the lamp source for passage only of the required excitation energy. As in the above-described arrangements, photon energy from the lamp 26 is absorbed by the fluorescent dye replica or image contained on the film 10 for excitation thereof and the emission of energy (generally in the form of radiation in the visible portion of the spectrum) which energy is detected by light-receiving means, such as photographic film within camera 20 for exposure of the film for any required length of time to achieve image enhancement. The dyed film may be restored to its original condition by removal of adsorbed dye therefrom, and reduction of the silver halide image to metallic silver.

PHOTOLUMINESCENCE TYPE IMAGE ENHANCEMENT WITH FLUORESCENT IMAGE TRANSFER

Frequently, the dye image will show brighter fluorescence if transferred from the silver halide image to a suitable receiving medium. The following procedure has been found to be satisfactory for practice of this invention using fluorescent image transfer. As with the above-described method, the original silver image negative first is bleached for conversion of the silver to silver iodide. As noted above, bleaching may be accomplished as by treatment with an aqueous solution containing, for example, 4% $K_3Fe(CN)_6$ and 2% KI, followed by a number of water rinses to remove the bleach solution from the gelatin. Next, the silver iodide image is dye-toned as by gentle agitation in a fluorescent dye solution. Examples of suitable dye adsorption solutions and typical toning times, which solutions are brought to 100 ml with distilled water, are as follows:

| Fluorescent Dye | g % | Glacial Acetic Acid (ml %) | Toning Time (min) |
|---|---|---|---|
| Acridine Orange | 0.2 | 2 | 3 |
| Acriflavine | 0.5 | 2 | 3 |
| Pyronin GS | 0.2 | 2 | 3 |
| Rhodamine B | 0.2 | 0.5 | 0.5–4 |
| | 0.1 | 0.25 | 0.5–4 |
| Safranine-T | 0.3 | 0.75 | 10 |

The film is washed with water until the non-image dye is removed from the film. Fluorescent dye is adsorbed by the silver halide in an amount substantially directly related to the density of the silver halide image.

Now, instead of exciting the dye image adsorbed on the silver halide, as is done in the previous example, the fluorescent dye image is transferred to a receiving medium such as a gelatin coating contained on a substrate such as Mylar plastic film. Transfer is effected simply by intimate contact between the fluorescent dye image and receiving medium. The receiving medium may be conditioned to receive the dye image by soaking the same in a wetting agent and/or mordant. The wetting solution acts as a solvent for the fluorescent dye on the image and allows its rapid diffusion into the receiving gelatin, and the mordant serves to insolubilize the dye on the receiving substrate. A typical wetting agent which may be used includes a 1% aqueous solution of Ethoquad C/12 [methylbis (2-hydroxy-ethyl) cocoammonium chloride, Armak Chemicals]. Typical mordants which may be used include either Phosphotungstic acid (PTA) or naphthalenesulfonic acid (NSA) at concentrations of, say, between 1% and 5% in water.

The fluorescent dye image is transferred to the conditioned, or pretreated, receiving medium as by first rinsing the dyed original image with water, and removing excess water with a squeegee. The wetted dyed image and the pretreated receiving substrate then are pressed together for transfer of the fluorescent dye image onto the receiving gelatin film pretreated with a wetting agent and/or mordant. A laminator may be used for pressing the films together, and intimate contact therebetween may be maintained for a suitable period of time, say, 5 minutes, by use of a vacuum frame. The two films then are peeled apart, and the transferred dye image is briefly rinsed in cold water, after which the film is dried. The fluorescent dye replica of the original metallic silver image is excited by use of a suitable photon source for photoluminescence thereof. Optical arrangements of the type illustrated in FIGS. 1–3, described above, may be used for exciting the dye images and for receiving and utilizing emitted energy therefrom, and such description will not be repeated here.

The original dye toned image may be rinsed and retoned for additional image replication. Alternatively, the adsorbed dye may be removed from the original film, and the silver image restored as by treatment of silver halide image in a suitable reducing bath for reduction of the silver halide to metallic silver. Non-destructive methods of image enhancement are preferred over prior art destructive methods.

DELAYED FLUORESCENCE DETECTION METHOD

The prime requirement for success of the luminescing image technique of photographic image enhancement of the present invention is the achievement of a high signal-to-noise ratio. Unfortunately, many chemicals used in the manufacture of photographic films fluoresce when exposed to ultraviolet light. The plastic backing materials and almost all gelatin coatings currently used in the industry fluoresce to some degree.

The detrimental effect of this undersirable accompanying fluorescence noise, that is, lower signal-to-noise ratio, is most severe if the fluorescing replica or image, is on the original negative film, as in the first method described above. This effect is significantly decreased by use of the dye image transfer technique, such as described immediately above, which allows the use of fluorescence-free materials. Also, the use of narrow-bandpass filters in the path of the source of excitation and in the received luminescence path will contribute to an improved signal-to-noise ratio.

Another technique of known type which may be used for improving the signal-to-noise ratio of the system is that of delayed-fluorescence detection. For this use, a luminescent dye having a longer persistence than that of the background fluoresence may be used. For example, phosphorescence dyes may be employed having a persistence longer than the generally shorter persistence background fluorescence may be used. The means for exciting the dye is pulse operated, as is the receiving means for receiving radiation from the excited dye image. Operation of the receiving means, following excitation, is delayed until the background fluorescence is extinguished. As noted above, commercially available delayed-fluorescence equipment for practicing such method is available and no further description thereof is required.

The invention having been described in detail in accordance with the requirements of the U.S. Patent Statutes, various changes and modifications will suggest themselves to those skilled in this art. It will be readily apparent that the image enhancement method of the present invention is applicable to both underexposed imagery and low-density regions of properly exposed imagery. As noted above, the method is applicable to both latent, or invisible, and patent, or visible, photographic, image enhancement. Also, as noted above, the invention is not limited to use with photographs produced by a particular photographic method. Additionally, as noted above, different photoluminescent systems may be employed in the practice of this invention. The term replica of a photographic image, as used herein, applies to images produced at a latent or patent photographic image, as well as to those which are transferred therefrom onto a receiving medium. It here will be noted that prior art toners which contain silica particles are known, as are toners which contain organic dye. However, in no case are applicants aware of specific reference to the fluorescent properties, much less to the use thereof for photographic image enhancement as claimed. It is intended that the above and other such changes and modifications shall fall within the spirit and scope of the invention as defined in the appended claims.

We claim:

1. In a method for the intensification of underexposed or low optical density regions of properly exposed metallic silver photographic images contained in a protective medium on a film and produced by exposure of the film to light, x-ray, or like radiant energy in a non-electrophotographic photographic process such as a conventional silver halide photographic process, which method comprises making said underexposed photographic image photoluminescent by providing on the film, in proportion to the localized radiant energy exposure of the film, a photoluminescent material, said step of making said underexposed photographic image photoluminescent including the steps of (a) converting said silver metallic image to a corresponding silver halide image, and (b) toning said silver halide image with a fluorescent dye to provide a corresponding fluorescent dye image thereof, exposing said photoluminescent image to a source of photons for exciting the same to luminescence in proportion to the localized optical density of said photoluminescent material used to make the photographic image photoluminescent, and recording said luminescence by recording means focused on the luminescent image during said exposing step for producing an intensified image of said underexposed photographic image to be intensified.

2. In an image intensification method as defined in claim 1 wherein said recording step includes photographically recording said luminescence.

3. In an image intensification method as defined in claim 1 wherein, said converting step provides a silver halide image having substantially the same relative localized optical density as the metallic silver image, and said toning step provides a fluorescent dye image having substantially the same relative localized optical density as the silver halide image.

4. In an image intensification method as defined in claim 3 wherein said exposing step comprises exposing said fluorescent dye image to radiant energy for the excitation thereof and emission of photons in proportion to the localized optical density of said dye.

5. In a method of obtaining an intensified image of an underexposed patent non-electrophotographic photographic image comprising, making said photographic image photoluminescent by photoluminescent material applied to the image such that when the luminescent image is exposed to photon excitation, photons are emitted therefrom in proportion to the relative localized optical density of said underexposed patent photographic image, exposing said photoluminescent image to photons to excite the same to luminescence, and recording photon emission from said photoluminescent image during said exposing step for producing an intensified image of said underexposed photographic image.

* * * * *